United States Patent [19]

Rosdil

[11] 4,043,083

[45] Aug. 23, 1977

[54] SANDING TOOL

[76] Inventor: Nicholas Paul Rosdil, 4550 Overlook Drive, NE., St. Petersburg, Fla. 33703

[21] Appl. No.: 679,223

[22] Filed: Apr. 22, 1976

Related U.S. Application Data

[63] Continuation-in-part of Ser. No. 557,359, March 11, 1975, abandoned.

[51] Int. Cl.[2] ..... B24B 23/06

[52] U.S. Cl. ..... 51/170 EB; 51/135 BT

[58] Field of Search ..... 51/170 EB, 135 BT

[56] References Cited

U.S. PATENT DOCUMENTS

| | | | |
|---|---|---|---|
| 2,556,041 | 6/1951 | Pick | 51/170 EB |
| 2,751,728 | 6/1956 | Petit | 51/170 EB |
| 2,976,652 | 3/1961 | Bedortha | 51/170 EB |
| 3,496,679 | 2/1970 | Dunn | 51/170 EB |
| 3,566,549 | 3/1971 | Britton | 51/170 EB |

FOREIGN PATENT DOCUMENTS

| | | | |
|---|---|---|---|
| 1,248,980 | 11/1960 | France | 51/170 EB |

*Primary Examiner*—Al Lawrence Smith
*Assistant Examiner*—Roscoe V. Parker
*Attorney, Agent, or Firm*—Stefan M. Stein; Robert F. Frijouf

[57] ABSTRACT

An endless belt sander comprising a drive pulley and an idle pulley to control an endless sanding or polishing belt having a length substantially longer than that required for surrounding the pulleys. The belt of any desired but applicable width and predetermined length is wrapped around a workpiece of limited accessibility, regardless of the diameter of such workpiece. The belt is kept from slipping on the drive pulley by use of a pressure pulley which forceably acts upon that portion of the belt engaging the drive pulley.

5 Claims, 3 Drawing Figures

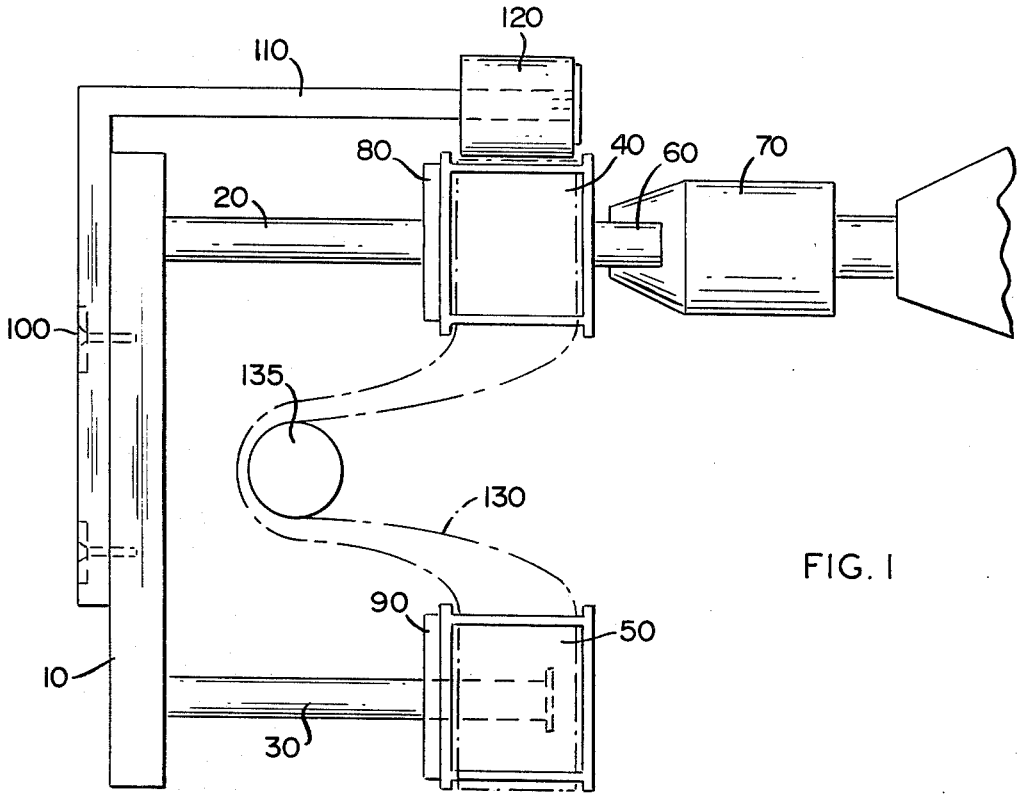
FIG. 1
FIG. 2
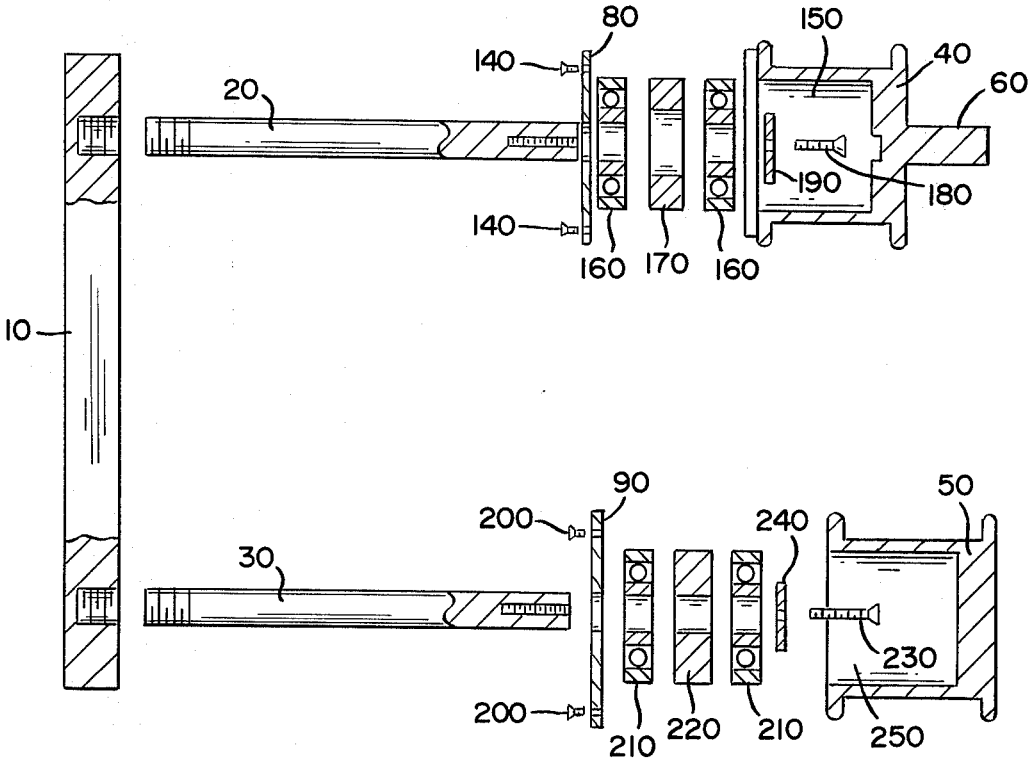

SANDING TOOL

This application is a continuation-in-part application of Ser. No. 557,359, filed Mar. 11, 1975 and now abandoned.

BACKGROUND OF THE INVENTION

1. Field of the Invention

An endless belt sander comprising an arrangement of pulleys to control an endless belt which partially surrounds a workpiece of substantial diameter.

2. Description of the Prior Art

There has long existed the problem of not having a sufficient means of sanding or polishing surfaces of limited access with mechanical devices and the exertion of excess manual effort. An example of such a situation is the difficulty encountered in trying to sand the entire circumference of stair bannisters from the stair side. A further example would be chair rungs commonly found in the arrangement of many designs of chairs. Furthermore, there are innumerable instances where surfaces to be sanded or polished are inaccessible by the devices found in the prior art where the access openings to that object which is to be sanded are smaller than the apparatus that must be extended within. Quite often the devices of the prior art have rollers to control the polishing or sanding belt which have rollers that must be extended within such openings but unfortunately have diameters which are of such dimensions that they will not fit within such openings.

The sanders commonly found in the prior art are not configured so as to allow the belt to engage a substantial portion of a curved surface. Commonly such sander assemblies have a belt tightly wrapped around a configuration of pulleys or rollers so that they form a substantially flat plane in which to engage a curved surface. This allows for only a small portion of that curved surface to be sanded in any short period of engagement. There is a need in this field to have a sander that is capable of wrapping around a substantial portion of a curved or circular surface so as to complete the sanding or polishing process in a uniform manner without having to have a series of rearrangement of the point of engagement of the sanding device with the workpiece. Furthermore, the requirement of having the belt tightly wrapped around an arrangement of pulleys or rollers results in the length of the belt having to be relatively short.

The devices of the prior art commonly drive the belt on the pulleys without belt slippage by having the belt tightly wrapped around an arrangement of pulleys or rollers. This method of insuring proper transfer of torque without belt slippage requires tension of the belt around the pulleys. This is commonly accomplished by having at least one pulley on an adjustable extended arm which can tighten the tension in the belt. Of course, such an arrangement totally prevents the wrapping of an originally slacked belt around a workpiece of substantial diameter or disposed in an area of limited access.

Likewise, any such device overcoming the above problems should also be portable enough to easily be taken to the jobsite without having to remove the object to be sanded.

Thus, it is apparent that a real need exists for a polishing or sanding device that is capable of being used in places of limited access, having a belt of unlimited length and width, engaging substantial portions of curved surfaces and objects of large diameters, of transferring power without belt slippage having a rather slack belt arrangement, and at the same time being portable.

SUMMARY OF THE INVENTION

This invention relates to an endless belt sander comprising a drive pulley and an idle pulley to control an endless sanding or polishing belt that has a length substantially longer than necessary to wrap around the above-mentioned pulleys. The drive pulley and the idle pulley are each mounted on a shaft. The two shafts on which the pulleys are mounted are attached at the other end to a handle so that the shafts extend outward from the handle in a protruding fashion to keep the pulleys in a spaced apart, adjacent arrangement. Attached to the opposite side of the drive pulley relative to the side attached to the shaft is a short shaft which permits a chuck to be attached and to drive the drive pulley. A pressure pulley arm which holds a pressure pulley against the sanding or polishing endless belt prevents the belt from slipping off the drive pulley and maintains the frictional grip of the drive pulley on the belt. Once the belt has been placed on the two pulleys with the pressure pulley in place to hold the belt on the drive pulley, the belt is then wrapped around the workpiece.

In one embodiment of the present invention the drive pulley and the idle pulley are aligned with the rotational axis disposed in a line along the elongated axis of their respective shafts. Such an arrangement results in the belt having to take a 90° twist in order to engage the workpiece. In operation, the advantage of such a novel arrangement allows for the use of a very wide sanding or polishing belt in places of limited access. For example, when this embodiment is used for sanding or polishing a stair bannister with numerous spaced apart shafts, each of the pulleys on their respective shafts will be extended between two adjacent shafts with the diameter of the pulleys determining whether or not such pulleys can be extended therein. However, if the pulleys had been turned in such a manner as shown in the second embodiment hereinafter described, the width of the opening would have to be greater than the width of the belt. Therefore, this embodiment allows for a belt of any width to be used in sanding a workpiece even though the pulley would have to be extended between adjacent shafts having such spacing that is less than the width of the endless belt.

In another embodiment of the present invention the drive pulley and the idle pulley are aligned in an arrangement so that their rotational axis is perpendicular to the longitudinal axis of their respective shafts on which they are attached. Furthermore, the rotational axis of the two pulleys are parallel relative to each other. Likewise, the pressure pulley is mounted so that its rotational axis is perpendicular to that of its supporting shaft, but performs and is aligned relative to the drive pulley in the same manner as described in the first embodiment. In this embodiment of the invention the workpiece can be positioned between the two shafts supporting the idle and drive pulleys or it can be situated between the two pulleys relative to that side of the pulleys that are not attached to their mounting shafts. Since the workpiece can be situated in front of the endless belt sander the diameter of the workpiece does not have to be such that it can fit between the two pulleys. Therefore, the endless belt sander can sand or polish a workpiece having a diameter many times larger than the distance between the axis of the shafts supporting the pulleys.

In addition to being able to sand workpiece having very large diameters, the second embodiment of this invention is capable of sanding surfaces accessible only through openings which are substantially smaller than the diameters of the pulleys. For example, if this embodiment of the present invention is utilized to sand the shafts in a bannister, the belt can be threaded through the opening created by the adjacent shafts and thereby wrapped around the workpiece, which in this example consists of one of the shafts. Such an opening between adjacent shafts need only be of a width slightly greater than two layers of the belt. Therefore, this invention can be utilized in sanding surfaces of severely limited access with the only limitation being that of having an accessible area around the workpiece sufficient to wrap the belt.

A further advantage to the present invention which is a characteristic of both embodiments is the ability to have an endless belt that is substantially longer than that required to wrap around the idle and drive pulleys. By having such an arrangement which would allow for having a belt of at least a predetermined length. This results in the present invention having the capability of wrapping around the workpiece. As already noted, the ability to wrap around the workpiece permits the user of the invention to sand or polish surfaces of very limited access. Furthermore, the wrapping of the belt around the workpiece results in the efficient sanding or polishing of curved surfaces. The devices of the prior art normally have belts with high tension applied thereto so that in sanding the workpieces the belt is formed in a plane that is substantially flat. The engagement of a curved surface by a flat planed sanding surface results in a limited area of the curved surface being engaged. This can create great inconsistency and lack of uniformity in sanding the curved surface. However, the arrangement of the belt in the present invention permits the sanding of a substantial portion of a curved surface since the belt is wrapped around the workpiece.

The present invention includes a novel way of keeping the belt from disengaging the pulleys. As already mentioned, the pressure pulley forceably engages the exterior surface of the belt so as to force the oppositely disposed side of the belt against the drive pulley. This creates a sufficient frictional grip so that efficient torque can be transferred from the drive pulley to the belt without the belt slipping. In having such an arrangement to prevent the belt from slipping, no sacrifice of the length of the belt is required. The common method in the prior art of preventing belt slippage is to have an arrangement which creates such a tension of the belt around the pulleys that slippage is impossible. Such an arrangement may be created by maintaining the tension by means of an outwardly curved pivotal arm. However, in the present invention no such tension is required and therefore the belt can be of any length needed to wrap around the workpiece.

The sander can be mounted for stationary use or carried to the job in the version described in this application. Therefore, the present invention can be used to polish large shafts or shafts of limited access on the job without removing them and on chair rungs and bannisters without dismantling them.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed discussion taken in connection with the accompanying drawings in which:

FIG. 1 shows the present invention with the pulleys having their rotational axis aligned with the longitudinal axis of their supporting shafts.

FIG. 2 is an exploded view of the present invention as shown in FIG. 1.

Similar reference characters refer to similar parts throughout the several views of the drawings.

DETAILED DESCRIPTION

Figure 3:
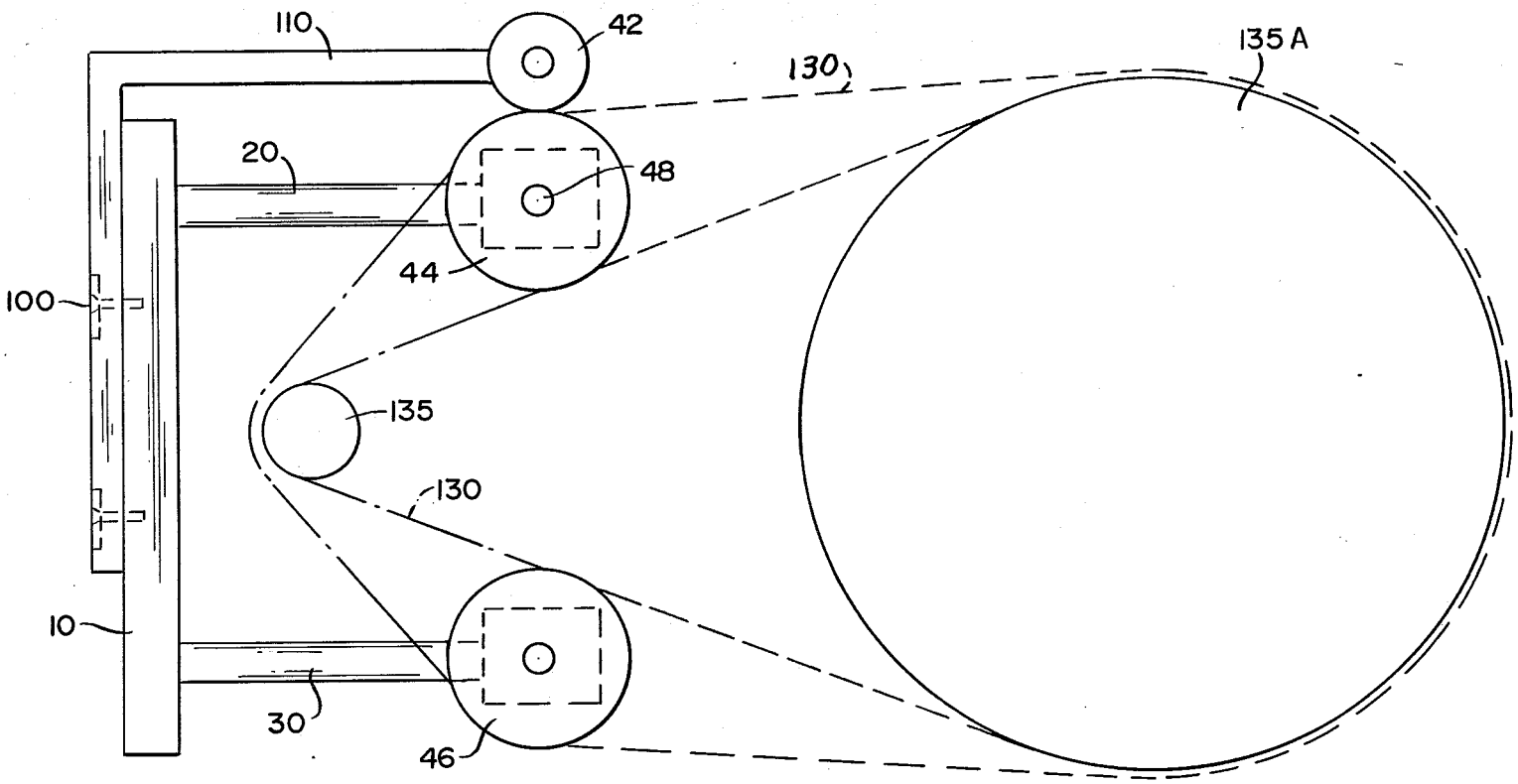
FIG. 3 shows another embodiment of the present invention with the pulleys having their rotational axis perpendicular to their supporting shafts.

This invention relates to a new and useful endless belt sander comprising, as shown in FIG. 1, a drive pulley means 40 and an idle pulley means 50 arranged in such a manner as to control an endless sanding or polishing belt means 130. The drive pulley means 40 is mounted on the drive pulley support shaft means 20 and the idle pulley means 50 is mounted on the idle pulley support shaft means 30. The two support shaft means 20 and 30 are mounted at their opposite ends relative to the ends supporting the pulleys on a handle means 10 so that the pulleys are in spaced apart, adjacent relationship relative to each other.

A short shaft means 60 which is rigidly attached to the side of the drive pulley opposite to the side attached to its support shaft permits a chuck 70 as shown in FIG. 1 to be attached thereto. Such an attachment of a chuck allows for the drive pulley to be rotated by such a device as a drill or like power device. The device which is utilized to transfer power to the short shaft 60 is not intended to be part of this invention and can consist of any conventional method of delivering torque to a shaft.

End plates 80 and 90 attached to the sides adjacent to their supporting shafts of both the drive pulley means 40 and the idle pulley means 50 are utilized to help mount the pulleys.

A pressure pulley arm means 110 holds a pressure pulley means 120 against the belt 130, as shown in FIG. 1. This keeps the belt means 130 from slipping off the drive pulley means 40 and maintains the necessary frictional grip of the drive pulley means on the belt.

In FIG. 2, the drive pulley means 40 is attached by screws 140 to the end plate 80 which retains in the cavity of the drive pulley means 150 two bearings 160 and a bearing spacer 170. A screw 180 and washer 190 keep the shaft means 20 in the cavity of the drive pulley means 150. The other end plate 90 is screwed by way of screws 200 into the idle pulley means 50, retaining a pair of bearings 210 and a bearing spacer 220. A screw 230 and washer 240 retains the shaft 30 in the cavity of the idle pulley 250. The bearings 160 and 210 cooperate to rotatably connect the pulleys 40 and 50, to the shafts 20 and 30, permitting the belt 130 of FIG. 1 to polish or sand a workpiece of FIG. 1, operated by an electric drill either directly or through a flexible shaft.

In another embodiment of the present invention, as shown in FIG. 3, the drive pulley means 44 is mounted with its rotational axis perpendicular to the longitudinal axis of its support shaft means 20 and idle pulley means 46 is mounted with its rotational axis perpendicular to the longitudinal axis of its support shaft means 30. Furthermore, the rotational axis of both pulleys 44 and 46 are parallel relative to each other. The pressure pulley means 42 is likewise mounted with its rotational axis perpendicular to the longitudinal axis of its support shaft 110 with this rotational axis also being parallel to the rotational axis of pulley means 44 and 46. As in the first embodiment, the pressure pulley means 42 is adjacent to the drive pulley means 44 and forceably engages therewith so as to prevent the slippage of the belt 130. The short shaft means 48 is rigidly attached to the outer surface of that side of the drive pulley means that is not used for mounting. As in the earlier embodiment, the short shaft is used to attach a chuck for driving the drive pulley means 44.

In operation, the use of the first embodiment of the present invention will permit the insertion of the workpiece 135 between the two support shaft means 20 and 30 as shown in FIG. 1. This embodiment of the present invention is particularly advantageous when used between a plurality of spaced apart, adjacent shafts. The width of the belt can be of any dimension since the spacing between corresponding adjacent shafts need only be wide enough to receive the diameter of the roller. The belt 130 which comes off of the pulley means 40 and 50 twists approximately 90° so as to engage the workpiece 135, as shown in FIG. 1. The chuck 70 is then connected to the short shaft means 60 so as to drive the belt which in turn sands a substantial portion of the workpiece 135. Moreover, while the chuck 70 is delivering torque to the drive pulley means 40, the pressure pulley means 120 is providing sufficient frictional forces to maintain the belt 130 on the drive pulley means 40 without belt slippage.

In operation, the second embodiment of the present invention permits the placing of the workpiece 135 within the enclosure between the adjacent support shafts 20 and 30 or placing of a workpiece 135*a* in a position in front of the two pulley means 44 and 46, as shown in FIG. 3. A common situation where this particular embodiment is of great advantage is where the openings between adjacent shafts is such as not to permit the insertion of rollers on either side of one shaft. The belt is threaded through the openings on either side of the workpiece 135*a* so as to surround and engage a substantial portion of the workpiece. This threading of the belt through the opening can be accomplished even though the opening is not much larger than two thicknesses of the belt.

It will thus be seen that the objects made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Now that the invention has been described, what is claimed is:

1. An endless belt sander for sanding or polishing a workpiece comprising an external power source, a support structure, a single drive pulley mounted on said support structure and disposed in power receiving relationship to said external power source, a single idle pulley mounted on said support structure, an endless sanding or polishing belt having a length greater than the minimum length necessary to surround said drive pulley and said idle pulley, said belt being slack and extending only about said pulleys, pressure pulley means attached to said support structure and established relative to said drive pulley to be in biasing engagement with that portion of said endless belt which is at any instant disposed in engaging relationship with said drive pulley to prevent slippage of said endless belt relative to said drive pulley, said endless belt disposed in looped-around relationship to the workpiece to provide sanding of the workpiece upon establishing tension on said endless belt by the position of said endless belt sander relative to the workpiece.

2. An endless belt sander as in claim 1 wherein said support structure comprises handle means, drive pulley shaft means attached at one end to said handle means with said drive pulley mounted on the other end of said drive pulley shaft means, idle pulley shaft means attached at one end to said handle means with said idle pulley mounted on the other end of said idle pulley shaft means.

3. An endless belt sander as in claim 2 wherein the rotational axis of said drive pulley is in substantial alignment with the longitudinal axis of said drive pulley shaft means, the rotational axis of said idle pulley is in alignment with the longitudinal axis of said idle pulley shaft means.

4. An endless belt sander as in claim 2 wherein the rotational axis of said drive pulley is at substantially right angles to said drive pulley shaft means, the rotational axis of said idle pulley is at substantially right angles to said idle pulley shaft means, and said pulleys being substantially parallel relative to each other.

5. An endless belt sander as in claim 1 wherein said drive pulley further comprises a short shaft attached to the opposite side thereof relative to said side mounted to said drive pulley, said external power source disposed in torque transferring relationship to said short shaft.

* * * * *